United States Patent [19]

Barrus et al.

[11] Patent Number: 4,687,359

[45] Date of Patent: Aug. 18, 1987

[54] COLOR PRINTER

[75] Inventors: Gordon B. Barrus, San Juan Capistrano; Leo J. Emenaker, El Segundo, both of Calif.

[73] Assignee: Printronix, Inc., Irvine, Calif.

[21] Appl. No.: 843,852

[22] Filed: Mar. 20, 1986

Related U.S. Application Data

[63] Continuation of Ser. No. 599,062, Apr. 11, 1984, abandoned.

[51] Int. Cl.[4] ..... B41J 33/40; B41J 33/34; B41J 35/18

[52] U.S. Cl. ..... 400/218; 400/225; 400/240.3; 400/240.4

[58] Field of Search ..... 400/218, 219, 239, 223, 400/240.2, 240.3, 240.4, 225; 101/336, 93.04, 93.05

[56] References Cited

U.S. PATENT DOCUMENTS

| | | | |
|---|---|---|---|
| 3,274,039 | 9/1966 | Ploeger, Jr. | 400/240.4 X |
| 4,037,708 | 7/1977 | Walker-Arnott | 400/240.4 X |
| 4,289,069 | 9/1981 | Melissa et al. | 400/240.3 X |
| 4,403,874 | 9/1983 | Payne | 400/124 |
| 4,528,576 | 7/1985 | Koumura | 346/75 X |

FOREIGN PATENT DOCUMENTS

| | | | |
|---|---|---|---|
| 6786 | 1/1982 | Japan | 400/240.3 |
| 193377 | 11/1982 | Japan | 400/240.4 |
| 94483 | 6/1983 | Japan | 400/240.3 |

OTHER PUBLICATIONS

*IBM Tech. Disc. Bulletin*, by G. N. Baker, vol. 22, No. 7, Dec. 1979, pp. 2633–2635.

*IBM Tech. Disc. Bulletin*, by T. Kirschner, vol. 26, No. 10B, Mar. 1984, p. 5385.

*Primary Examiner*—Paul T. Sewell

*Attorney, Agent, or Firm*—Bogucki, Scherlacher, Mok & Roth

[57] ABSTRACT

In a color printer in which a shuttle assembly containing a plurality of impacting print hammers is reciprocated in bidirectional fashion relative to an opposing platen to impact a print paper against the platen through the different color zones of an ink ribbon to print in color, the different color zones of the ribbon are arranged in a repeating pattern along the length thereof enabling the lightest color to be printed first followed by successively darker colors as the ribbon is advanced bidirectionally between the opposite ends thereof. A pair of barrier zones having a blank ribbon zone therebetween are disposed between each adjacent pair of color zones on the ribbon to prevent ribbon contamination due to bleeding of ink between adjacent color zones when the ribbon is wound on a reel. Ribbon contamination is further prevented by the blank ribbon zones which absorb ink that rubs off onto the ribbon guides. The various different color zones are identified by one or more strips which extend across the width of the ribbon adjacent each color zone and which identify the color therein in bar code fashion. The color printer may be operated in a manner which provides multiple passes of each color zone through the print station between the shuttle assembly and the platen to prolong the life of the ribbon and to enable the printer to quickly advance to the next color zone with a minimum amount of search time. The print paper which is driven bidirectionally by tractor drives above the print station is held in tension by an arrangement below the print station which employs a torque motor having an elastomeric wheel engaging a side of the paper opposite an arrangement of non-ink absorbing rollers.

4 Claims, 13 Drawing Figures

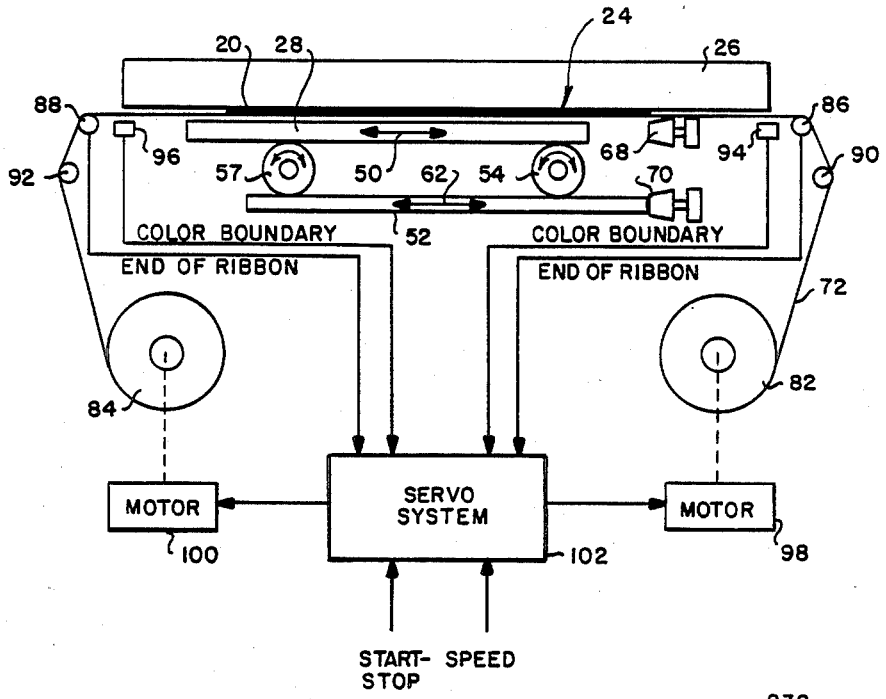
FIG. 2
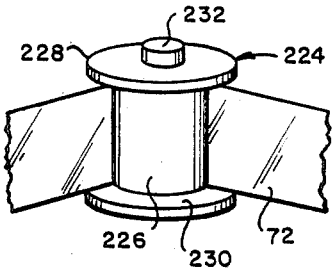
FIG. 13
FIG. 11
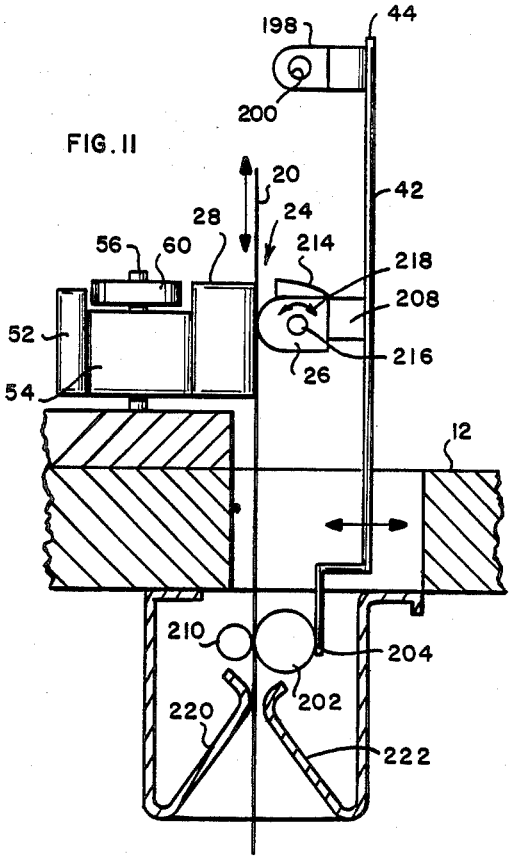
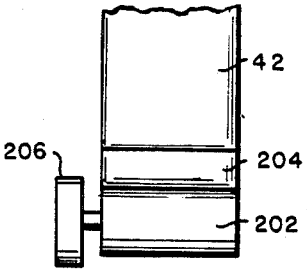
FIG. 12

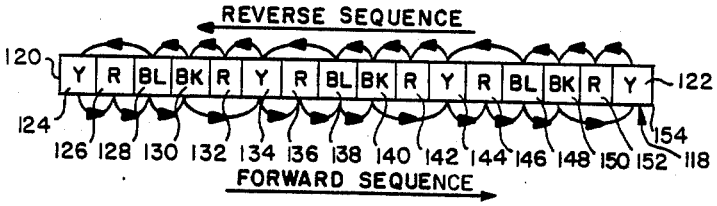
FIG. 4
FIG. 6
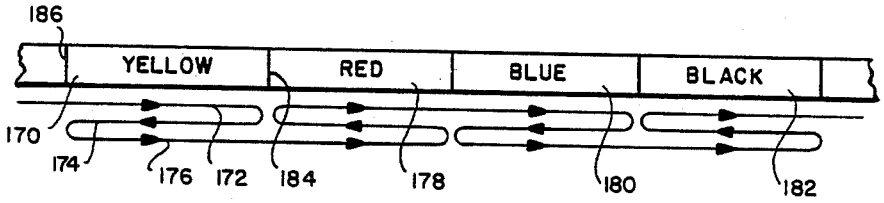
FIG. 7
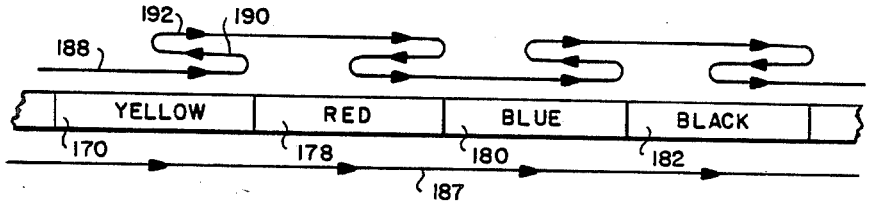
FIG. 5
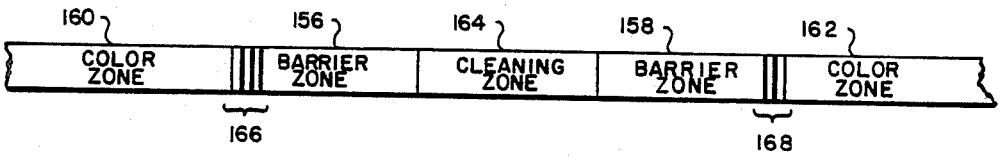
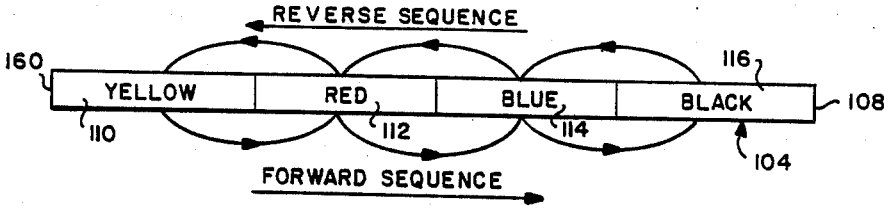
PRIOR ART
FIG. 3

COLOR PRINTER

This is a continuation of co-pending application Ser. No. 599,062 filed on Apr. 11, 1984, now abandoned.

BACKGROUND OF THE INVENTION

1. Field of the Invention

The present invention relates to color printers, and more particularly to color printers to the dot matrix impact type in which the different color zones of an ink ribbon are successively impacted to provide printing in color.

2. History of the Prior Art

It is known to provide a color printer of the dot matrix impact type in which the different color zones of an ink ribbon are impacted in succession to provide printing in color. Examples of such a printer are provided by U.S. Pat. Nos. 4,289,069 and 4,336,751 of Melissa et al. The Melissa et al patents describe a color printer having an ink ribbon the length of which is basically divided into three different color zones. Printing in color is accomplished by advancing a first one of the color zones of the ribbon to a print station between a platen and a bidirectionally reciprocating shuttle assembly containing impacting hammers. A page or other document of convenient length is then printed in the color contained in the first zone of the ink ribbon. Tractor drives are employed to advance the print paper in a first direction through the print station as the page is printed in the first color. Following printing of the page in the first color, paper advancement is reversed to return the page in preparation for the printing thereof using the second color zone of the ink ribbon which is advanced into the print station. Following printing of the page in the second color, the paper is again reversed in preparation for printing the page in a third color using the third color zone of the ribbon which is advanced into the print station. By using different combinations of colors and the dots that are printed therefrom, a multi-color printing can be accomplished.

Despite the fact that multi-color printing is provided, the color printer described in the previously referred to Melissa et al patents suffers from a number of disadvantages. One such disadvantage relates to the arrangement of color zones on the ink ribbon. It has been found that the best results are achieved if printing is carried out starting with the lightest color and then proceeding through the increasingly darker colors. If the darker colors are printed first, there is a tendency for the darker ink already deposited on the print paper to rub off onto and thereby contaminate the lighter color zones of the ribbon as such lighter color zones are used for printing. In the three zone ribbon shown and described in the Melissa et al patents, it is simple enough to arrange the colors of the three zones so that the three colors go become progressively darker as the ribbon is advanced along the length thereof in a given direction. However if the ribbon is then driven in the opposite direction, the reverse becomes true and the darkest colors are presented first. The same problem exists where the basic three color pattern is repeated a plurality of times along the length of the ribbon. Again, the desired order of color presentation is achieved in one direction of ribbon movement, but the reverse is true in the opposite direction. It is desirable that the ribbon be driven bidirectionally from end to end during printing in order to optimize speed and efficiency. However, the three color zone ribbon arrangement of the Melissa et al patents is limited to ribbon advancement in a single direction if contamination thereof is to be minimized.

Accordingly, it would be desirable to provide a multi-color ribbon in which the lighter color zones are presented first followed by the darker color zones in either direction of ribbon drive.

In the printer shown and described in the previously referred to Melissa et al patents the ribbon is fed from one reel onto a second reel. Initially, the ribbon is entirely wrapped around the first reel. It is then driven in a first direction until it is substantially completely wound around the second reel, whereupon the direction of driving is reversed and the ribbon is fed from the second reel back onto the first reel. The ribbon typically extends through a path between the opposite reels including various guides. As the ribbon is wound onto either of the reels, portions of two different adjacent color zones are disposed in contact with or at least adjacent to one another. It has been found that in time the ink from one color zone can bleed into portions of the adjacent color zone and vice versa, causing contamination of the ribbon. It has also been found that ink from the various color zones tends to be transferred onto the various guides within the ribbon path. Such ink can then rub off onto color zones of different color, resulting in contamination of the ribbon.

Accordingly, it would be desirable to provide an ink ribbon in which contamination of the various color zones as a result of winding or storage of the ribbon on each of the opposite reels is minimized or eliminated. It would furthermore be desirable to provide a ribbon capable of cleaning some or all of the ink from the guides in the ribbon path so as to minimize or eliminate contamination of the ribbon.

In the color printer shown and described in the previously referred to Melissa et al patents the different color zones of the ribbon which are typically welded together to form the ribbon are identified using an arrangement which includes apertures that are provided in the opposite edges of the ribbon. In this way the printer is capable of identifying the particular color being presented at the print station at any given moment. However, while the arrangement of apertures is capable of identifying the different color zones, it may be desirable to provide a simpler and more reliable arrangement for identifying the color zones utilizing indicia which is easily added to the ribbon in conjunction with a standard coding scheme. It would also be desirable to provide a ribbon which does not have welds or other joints therein which are prone to breaking.

As previously discussed in connection with the color printer shown and described in the Melissa et al patents the ribbon therein is advanced in a given direction so as to present each of three different color zones of the ribbon to the print station in succession. It has been found that the resulting single pass made through each of the color zones can result in a relatively short ribbon life because of the uneven depletion of the ink that can result. For example, the ribbon may be driven at a speed that provides a single pass of a given color zone through the print station during the time required to print a complete page. However, if a number of pages are printed in which only the first portion of each page contains printed matter, then only the corresponding first portion of each color zone on the ribbon is used. This results in depletion of the ink at the first such portion of each color zone while the remaining portion of each color zone experiences little or no ink depletion. An arrangement capable of making ribbon use and the resulting ink depletion more uniform could result in greatly prolonged ribbon life. Furthermore, a single pass through each color zone does not always lend itself to fast and efficient operation, particularly where only portions of the pages contain printed matter and the printer must await advancement of the ribbon to the next ribbon zone at some nominal ribbon driving speed.

In color printers such as of the type shown and described in the previously referred to Melissa et al patents, it is necessary to reverse the paper advancement after a page is printed in a first color so that the same page can be printed in the remaining colors. One approach is to use pairs of conventional tractor drives both above and below the print station. This achieves bidirectional paper advancement rather successfully but at the expense of requiring two separate pairs tractor drives. In this connection it would be desirable to provide a paper driving arrangement in which only a single pair of tractor drives is required, while at the same time the paper is advanced bidirectionally under a desired amount of tension so as to maintain the desired tautness and alignment thereof. This should be done without risk of the smearing of ink on the already printed portions of the paper.

BRIEF DESCRIPTION OF THE INVENTION

The present invention provides a color printer in which the ink ribbon is designed and arranged so as to minimize or prevent contamination thereof and so as to otherwise prolong useful life of the ribbon. In addition, each color zone of the ribbon is advanced through the printer in multiple passes so as to again prolong ribbon life and at the same time provide for relatively fast and efficient printing in the face of the printing of pages having different amounts of printed matter less than a full page thereon. The paper feed within the printer is carried out in bidirectional fashion utilizing a relatively simple torque motor arrangement that holds the paper under tension without smearing the ink on the already printed portions thereof.

In one preferred arrangement of an ink ribbon in accordance with the invention the different color zones which are formed along the length of a continuous, non-welded fabric arranged in a progression which repeats itself along the length of the ribbon. The progression or pattern begins with the lightest color zone at a first end of the ribbon and then progresses through the next darker color zone to the darkest zone. Thereafter, the next darker color zone is repeated, followed by the lightest color zone to complete the progression or pattern. Accordingly, when advancing the ribbon in either direction, it is only necessary that an occasional color zone be skipped. Otherwise, the various color zones are presented at the print station in orderly sequence beginning with the lightest color and progressing through the increasingly darker colors. In one example, the progression or pattern begins with yellow and is followed by red, blue, black and then red again, whereupon the progression or pattern repeats. At the opposite end of the ribbon a yellow zone is added at the end of the progression or pattern.

As used herein the terms "lightness", "lighter", "darker" and variations thereof refer to the extent or degree to which ink of a particular color will contaminate a ribbon containing inks of other colors when the ink of a particulate color comes in contact with the ribbon. Contamination refers to the tendency of inks of all colors to destroy the uniformity, shade, purity and other characteristics of a section of ribbon containing ink of a different color. Experience has shown that colors such as yellow are readily contaminated by practically all other colors. Accordingly, easily contaminated colors such as yellows are viewed herein as being relatively light. Black on the other hand is the least susceptible to contamination by other colors and is therefore viewed herein as being a very dark color. Red is less subject to contamination than yellow but is more easily contaminated than blue and black. Red is therefore considered herein to be darker than yellow but lighter than blue and black. Blue is less subject to contamination than yellow and red but is more easily contaminated than black. Blue is therefore considered herein to be darker than yellow and red but lighter than black. Other colors can be categorized in terms of relative lightness and darkness in accordance with their tendency to contaminate or be contaminated by yellow, red, blue and black.

In accordance with the invention contamination problems due to inks bleeding through the ribbon between color zones when the ribbon is stored on a reel are minimized or eliminated by including a pair of barrier zones between each adjacent pair of color zones on the ribbon. The barrier zones are preferably coated with a non-wetting material such as a fluorochemical polymer silicone to prevent the bleeding of ink therethrough. Each barrier zone preferably has a length at least equal to the outer circumference of the ribbon reel to insure that no portion of a color zone on the ribbon overlaps another portion of the ribbon other than the adjoining barrier zone. A blank ribbon zone is provided between the pair of barrier zones separating each adjacent pair of color zones. The blank zone consists of a section of raw ribbon which rubs against and is effective in removing ink which becomes deposited on guides and other elements within the ribbon path.

The different color zones of ribbons in accordance with the invention may be identified by different groups of indicia consisting of strips extending across the width of the ribbon and arranged in standard bar code format. Each such set of indicia is preferably located within the barrier zone adjacent an end of each color zone. The indicia includes a desired number of strips of selected width so as to identify the color of the zone in bar code fashion as well as the opposite ends of the ribbon. The strips are preferably applied to the ribbon by foil hot stamping. The resulting bar coded information is easily read using optical sensors located within the ribbon path.

Color printers in accordance with the invention are preferably operated so that each of the plurality of color zones along the length of the ribbon makes a plurality of different passes through the print station as the color thereof is printed on a page. An odd number of such passes is required, and typically the ribbon undergoes at least two reversals in direction to provide a minimum of three different passes of the color zone through the print station. Greater numbers of passes such as five or seven can also be used where desired. The use of multiple passes has the advantage of more evenly distributing the wear along the length of each color zone. A further advantage resides in the ability to print rapidly and efficiently where the pages being printed contain less than a full page of printed matter. The amount of matter to be printed on each page is determined, and the ribbon in the meantime is advanced through at least one pass of the color zone. When printing of the page using the color zone is thereafter completed, the printer is prepared to quickly reverse the direction of ribbon drive if the end of printing occurs during an even numbered pass and then immediately advance the ribbon to the beginning of the next color zone. Where desired, the ribbon speed can be increased from a nominal speed when searching for the next color zone to further reduce the color selection time.

In accordance with the invention bidirectional paper advancement can be provided in conjunction with a standard tractor drive using a paper tensioning arrangement which engages the paper on the opposite side of the print station from the tractor drive and which moves in the same direction as the tractor drive but at a different speed so as to maintain the paper in a desired amount of tension through the print station. Such arrangement may comprise a torque motor coupled to a wheel having an elastomeric surface which engages the print paper on a side thereof opposite a plurality of rollers rotatably mounted in side-by-side relation. The outer surfaces of the rollers are preferably of a non-wetting material such as Teflon or Delrin so as to resist the absorbtion of any ink from the already printed portions of the paper which might otherwise result in contamination. The torque motor and associated drive wheel are mounted on the lower end of a bracket having an opposite upper end pivotally coupled to the tractor drive and an intermediate portion mounting a permanent magnet. The permanent magnet normally clamps itself onto the back of the platen to pivot the bracket into a paper engagement position in which the drive wheel associated with the torque motor presses the paper against the rollers. During loading and unloading of the paper, the platen may be rotated so as to cam the permanent magnet away therefrom and thereby rotate the lower end of the bracket with the included torque motor and drive wheel into a position disengaged from the paper. The rollers are rotatably mounted within a generally rectangular housing which includes opposite paper guides, the paper guides converging toward each other in an upward direction to an area of minimum spacing therebetween immediately below the rollers and the torque motor and attached drive wheel.

In accordance with the invention the ribbon guides are preferably comprised of a rotatably mounted spools which rotate with ribbon movement and which have an outer surface of hard plastic or other non-wetting material. This greatly minimizes the amount of ink transferred onto the guides from the ribbon.

BRIEF DESCRIPTION OF THE DRAWINGS

The foregoing and other objects, features and advantages of the invention will be apparent from the following more particular description of a preferred embodiment of the invention, as illustrated in the accompanying drawings, in which:

FIG. 2 is a plan view of a portion of the printer of FIG. 1 together with a block diagram of a servo system for driving the ribbon thereof;

FIG. 3 is a representation of a typical prior art ribbon having a plurality of different color zones;

FIG. 4 is a representation of a ribbon having color zones arranged to present the colors in descending order of brightness in both directions of ribbon drive in accordance with the invention;

FIG. 5 is a representation of a portion of the ribbon of FIG. 4 illustrating the manner in which adjacent color zones are separated by barrier zones and a blank ribbon zone and are identified as to color using strips arranged in bar code format;

FIG. 6 is a representation of a portion of the ribbon of FIG. 4 illustrating a mode of operation of the color printer of FIG. 1 in which each color zone makes plural passes through the print station of the printer;

FIG. 7 is a representation of the ribbon of FIG. 4 similar to the representation of FIG. 6 and showing different examples of multiple passes of the color zones;

FIG. 11 is a sectional view of the arrangement of FIG. 10 in conjunction with a portion of the printer of FIG. 1;

FIG. 12 is a front view of a portion of the arrangement of FIG. 10; and

FIG. 13 is a perspective view of a roller guide for use in the ribbon path.

DETAILED DESCRIPTION

Figure 1:
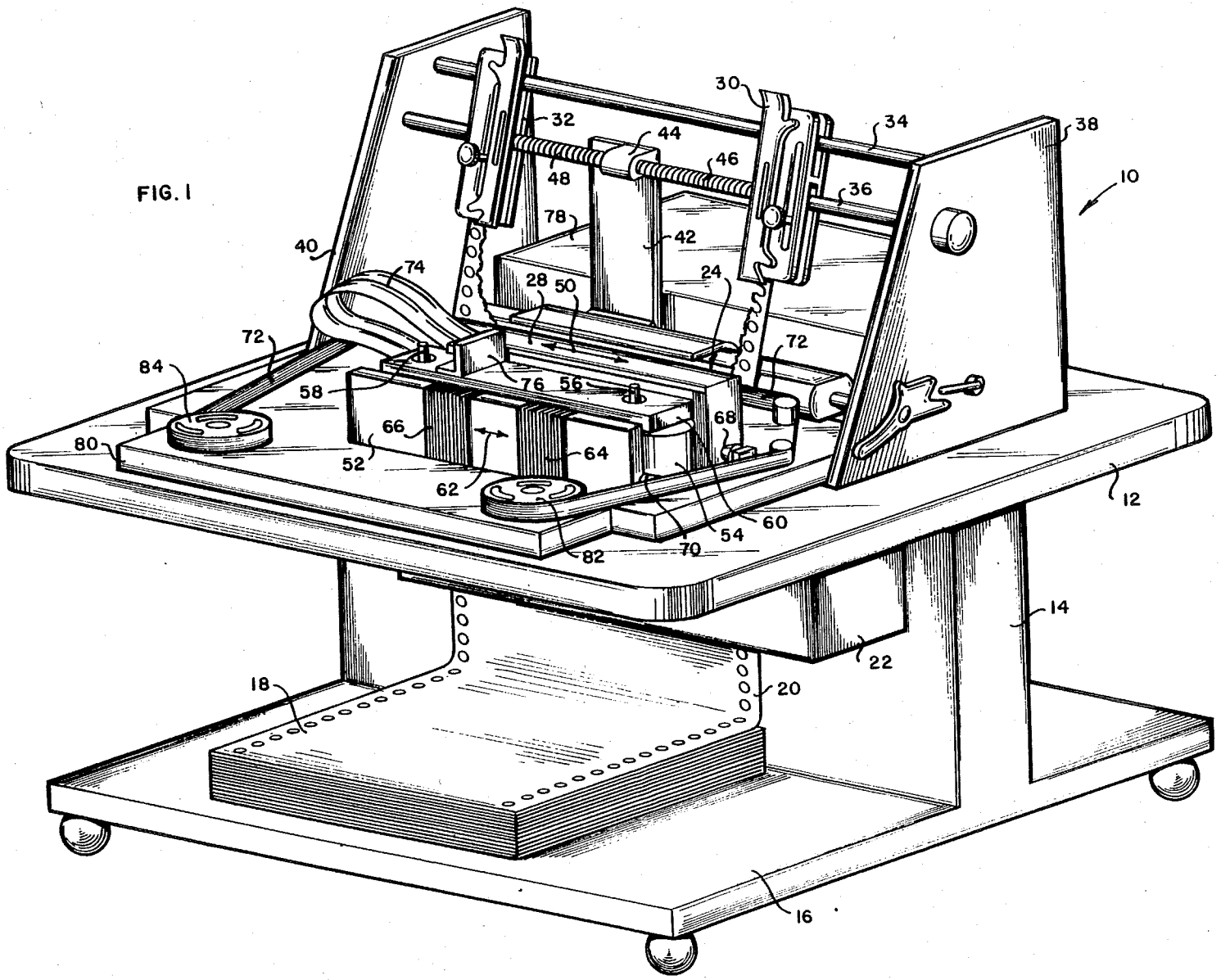
FIG. 1 is a perspective view of a color printer in accordance with the invention.

FIG. 1 depicts a color printer 10 in accordance with the invention. The color printer 10 includes a relatively flat base 12 thereof mounted on a support pedestal 14. The support pedestal 14 has a front portion 16 thereof for supporting a stack 18 of fan-folded edge-perforated multi-copy print paper 20. The print paper 20 from the stack 18 thereof is fed upwardly through a generally rectangular housing 22 to a print station 24.

The print station 24 is defined by the interface between an elongated platen 26 and a shuttle assembly 28. The print paper 20 extends through the print station 24 to a standard tractor drive arrangement comprised of an opposite pair of tractor drives 30 and 32. The tractor drives 30 and 32 which are mounted on shafts 34 and 36 extending between opposite mounting brackets 38 and 40 generally vertically disposed on the base 12 engage the perforations in the opposite edges of the print paper 20 to drive the paper 20 in well known fashion. Only portions of the opposite edges of the print paper 20 above the print station 24 are shown in FIG. 1 for clarity of illustration.

An elongated bracket 42 has an upper end 44 thereof pivotally mounted on the shaft 36. Coil springs 46 and 48 disposed around the outer surface of the shaft 36 between the upper end 44 of the bracket 42 and the opposite tractor drives 30 and 32 serve to keep the bracket 42 centered between the tractor drives 30 and 32. As described hereafter the bracket 42 has a torque motor and associated drive wheel mounted thereon (not shown in FIG. 1) for engaging the print paper 20 at a location below the print station 24. The torque motor and associated drive wheel move in the same direction as the tractor drives 30 and 32 but at a different speed so as to maintain a desired amount of tension within the print paper 20 within the print station 24.

The shuttle assembly 28 is mounted for reciprocating movement in bidirectional fashion relative to the platen 26 as represented by an arrow 50. The shuttle assembly 28 is disposed on the opposite side of a pair of rotatably pulleys from a counterbalancing bar 52. A first one 54 of the pair of pulleys is shown in FIG. 1 and is rotatable about a vertical shaft 56. A second one 57 of the pulleys which is not shown in FIG. 1 but is shown in FIG. 2 is rotatably mounted about a vertical shaft 58 spaced apart from the first vertical shaft 56. The shafts 56 and 58 are journaled within a horizontal disposed frame member 60.

As previously noted the shuttle assembly 28 undergoes reciprocating bidirectional motion as represented by the arrow 50. This motion is provided as the shuttle assembly 28 moves over the pair of rotatable pulleys 54 and 57. At the same time the counterbalancing bar 52 which is disposed on the opposite side of the pulleys 54 and 57 from the shuttle assembly 28 undergoes reciprocating motion in an opposite sense from that of the shuttle assembly 28 as represented by an arrow 62. The shuttle assembly 28 and the counterbalancing bar 52 are coupled to thin, flexible bands (not shown) which encircle the opposite pulleys 54 and 57 and which together with one or more appropriate magnetic arrangements (not shown) disposed between the shuttle assembly 28 and the counterbalancing bar 52 hold the shuttle assembly 28 and the counterbalancing bar 52 in contact with the pair of pulleys 54 and 57. Such arrangement is shown and described in detail in U.S. Pat. No. 4,359,289 of Barrus et al, Counterbalanced Bidirectional Shuttle Drive Having Linear Motor, which patent is commonly assigned with the present application and which is incorporated herein by reference.

U.S. Pat. No. 4,359,289 of Barrus et al also describes an appropriate apparatus for driving the arrangement which includes the shuttle assembly 28 and the counterbalancing bar 52 in bidirectional reciprocating fashion. Such apparatus includes permanent magnets disposed adjacent the inside of the counterbalancing bar 52 for magnetically interacting with a pair of coils 64 and 66 which surround portions of the counterbalancing bar 52. As described in Barrus et al U.S. Pat. No. 4,359,289 the coils 64 and 66 are energized by signals which drive the shuttle assembly 28 and the counterbalancing bar 52 at a relatively constant velocity through a substantial portion of the distance of travel thereof between opposite reversals in direction. In the present example the opposite reversals in direction are provided by bumper assemblies 68 and 70 mounted on the base 12 and disposed adjacent the ends of the shuttle assembly 28 and the counterbalancing bar 52 respectively. The shuttle assembly 28 and the counterbalancing bar 52 alternately impact the bumper assemblies 68 and 70 to provide reversal in the direction of movement thereof.

The shuttle assembly 28 contains a plurality of print hammers in the form of resilient hammer springs mounted along the length thereof in side-by-side fashion and each including an impact printing tip for printing a dot on the print paper 20. Each hammer spring is operated by an associated print hammer mechanism within the shuttle assembly 28 which employs a permanent magnet to hold the hammer spring in a retract position and a coil which momentarily overcomes the magnetic effects of the permanent magnet when energized so as to cause the hammer spring to fly out of the retract position and into contact with an ink ribbon 72 disposed between the shuttle assembly 28 and the platen 26. This causes the impact printing tip on the hammer spring to impact the ink ribbon 72 against the print paper 20 as supported by the platen 26 to print a dot on the print paper 20. Thereafter, the hammer spring returns to the retract position under the influence of the permanent magnet. Energizing current for the various coils of the different print hammer mechanism within the shuttle assembly 28 is provided by a flexible wire bus 74 which extends between the shuttle assembly 28 and a terminal bracket 76 mounted on the frame member 60. From the terminal bracket 76 the various wires of the wire bus 74 are coupled to appropriate circuitry within a housing 78 at the back of the printer base 12. The hammer springs and associated print hammer mechanisms within the shuttle assembly 28 are shown and described in U.S. Pat. No. 3,941,051 of Barrus et al, Printer System, which patent is commonly assigned with the present application and is incorporated herein by reference.

The color printer 10 includes a ribbon deck 80 mounted on the base 12 at the forward end thereof. The ribbon deck 80 has an opposite pair of reels 82 and 84 rotatably mounted thereon and containing the ink ribbon 72. The ribbon 72 extends from the reel 82 through a ribbon path which includes the print station 24 to the opposite reel 84. As best shown in FIG. 2 the ribbon path includes a pair of guides 86 and 88 disposed at opposite ends of the print station 24. Each of the guides 86 and 88 may contain an electrical sensor for determining when the end of the ribbon 72 is present thereat. Each of the opposite ends of the ribbon 72 can be provided with a conductive portion which, when present at one of the guides 86 and 88, provides an indication that the end of the ribbon 72 has been reached and that the direction of ribbon drive must be reversed. The ribbon path also includes an opposite pair of guides 90 and 92 disposed adjacent the guides 86 and 88. A pair of optical sensors 94 and 96 are disposed at the opposite ends of the print station 24 adjacent and just inside of the guides 86 and 88. The optical sensors 94 and 96 sense indicia on the ribbon 72 identifying the color of various color zones within the ribbon 72. The ribbon 72 can also contain indicia indicating the opposite ends of the ribbon 72, in which event the optical sensor 94 and 96 also provide this data in lieu of electrical sensors within the guides 86 and 88. The color and ribbon end identifying indicia and the composition of the ribbon 72 including the layout of the various color zones are described hereafter.

The reels 82 and 84 are driven by motors 98 and 100 respectively which are shown in FIG. 2. The motors 98 and 100 are mounted within the ribbon deck 80, and are coupled to a servo system 102 which is also shown in FIG. 2. The servo system 102 together with the motors 98 and 100 comprise for purposes of the present example the ribbon drive described in U.S. Pat. No. 4,177,731 of Kleist et al, Printer System Ribbon Drive Having Constant Ribbon Speed and Tension, which patent is commonly assigned with the present application and is incorporated herein by reference. The Kleist et al patent describes a printer system ribbon drive which comprises a servo system having a pair of motors for driving the opposite ribbon reels. The servo system drives the reel motors in response to external command signals so as to provide the ribbon with substantially constant speed and tension.

In like fashion the servo system 102 shown in FIG. 2 controls the motors 98 and 100 so as to feed the ribbon 72 between the reels 82 and 84 at a substantially constant speed and under substantially constant tension. With substantially all of the ribbon 72 wound upon one of the reels 82 and 84, the servo system 102 drives the reels 82 and 84 so as to advance the ribbon 72 from the substantially full reel to the substantially empty reel. Thus, if substantially all of the ribbon 72 is wound upon the reel 82, the servo system 102 drives the reels 82 and 84 to advance the ribbon 72 from the reel 82 to the reel 84. When substantially all of the ribbon 72 has been transferred from the reel 82 to the reel 84, the optical sensor 94 senses indicia on the ribbon identifying that the end of the ribbon 72 has been reached. This provides an "end of ribbon" signal to the servo system 102, and the servo system 102 responds by reversing the direction of drive of the reels 82 and 84. This causes transfer of the ribbon 72 from the reel 84 back to the reel 82. When substantially all of the ribbon 72 has been wound on the reel 82, the optical sensor 96 senses indicia at the opposite end of the ribbon 72 indicating that that end of the ribbon 72 has been reached. The resulting "end of ribbon" signal to the servo system 102 causes the servo system 102 to again reverse the direction of drive of the ribbon 72.

As previously mentioned the optical sensors 94 and 96 sense indicia on the ribbon 72 identifying the different color zones within the ribbon. This enables the servo system 102 to determine the particular ribbon color which is present in the print station 24 at any given instant. It also enables the servo system 102 to drive the reels 82 and 84 so as to provide multiple passes of each color zone through the print station 24 as described hereafter. Such multiple pass operation represents a departure from the standard operation in which the ribbon 72 is driven at a nominal speed in the same direction until the end thereof is reached. In multiple pass operation the direction of ribbon drive is reversed a number of times to provide repeated passes of each color zone of the ribbon 72 through the print station 24, and as described hereafter the capability exists for a high speed ribbon search which can enable the ribbon drive to proceed at high speed to the next color zone.

As previously described herein and as described in detail in previously referred to U.S. Pat. No. 4,359,289 of Barrus et al, the shuttle assembly 28 is driven along the print station 28 in bidirectional reciprocating fashion by action of a linear motor which includes the coils 64 and 66 on the counterbalancing bar 52. As the shuttle assembly 28 moves along the print station 24 the various print hammers contained therein are selectively actuated or "fired" by electronic circuitry contained within the housing 78 so as to impact the print paper 20 against the platen 26 through the ribbon 72 to print dots. The bidirectional reciprocation of the shuttle assembly 28 carries it through a sufficient distance so that the various print hammers contained therein can print across substantially the entire width of the print paper 20. The sweep or stoke of the shuttle assembly 28 across the print station 24 is determined in part by the number of print hammers contained within the shuttle assembly 28. Thus, in the case where the shuttle assembly 28 contains 17 print hammers, the shuttle assembly 28 must have a stroke or sweep of 0.8 inches to adequately cover a print paper which is typically $14\frac{7}{8}$ inches wide. Where the shuttle assembly 28 contains 33 print hammers, the required stroke or sweep is 0.4 inches.

Each time the shuttle assembly 28 sweeps across the print paper 20 in either direction, a dot row is printed on the paper 20. During the opposite turnaround intervals of the shuttle assembly 28 when either the bumper assembly 68 is impacted by the shuttle assembly 28 or the bumper assembly 70 is impacted by the counterbalancing bar 52, the paper 20 is incremented upwardly by the tractor drives 30 and 32 to the next dot row position which is then printed during the next sweep of the shuttle assembly 28 across the print paper 20. Simultaneously with reciprocation of the shuttle assembly 28 across the print paper 20, the ribbon 72 is driven through the print station 24 by the servo system 102 at a desired nominal speed such as 3 inches per second or 6 inches per second. Movement of the ribbon 72 at some nominal speed is required to prevent a greatly shortened ribbon life which would otherwise result from depletion of ink from impacted areas of the ribbon, were the ribbon to remain stationary or be driven at too slow a speed.

Color printing requires that the printed matter be printed in a plurality of different colored inks. A minimum of three colors is usually preferred to provide acceptable color quality and versatility with four or five color printing being preferred for certain applications to provide greater color quality and variety. Initially, a page of the print paper 20 has the various dot row positions thereof through the print station 24 by the tractor drives 30 and 32 to print a predetermined arrangement of dots in a first color on the paper 20. During printing of such first color, the servo system 102 insures via signals detected by the optical sensors 94 and 96 that the correct first color on the ribbon 72 is present within the print station 24. Following printing of the page in the first color the tractor drives 30 and 32 reverse the direction of paper movement and return the print paper 20 to the beginning of the page in preparation for printing in a second color. In the meantime the servo system 102 advances the ribbon 72 in the high speed search mode so that a color zone thereof containing the second color to be printed is located within the print station 24. The tractor drives 30 and 32 again increment the various dot row positions of the page through the print station 24 as the reciprocating shuttle assembly 28 prints a predetermined arrangement of dots on the page in the second color. The process is then repeated for a third color and any additional colors which are to be printed on the page. When the last color has been printed on the page, the tractor drives 30 and 32 do not return the beginning of the page to the print station 24 but rather continue to advance the print paper 20 in the upward direction through the print station 24 as printing of the next page is begun.

The color printer described in previously referred to U.S. Pat. Nos. 4,289,069 and 4,336,751 of Melissa et al utilizes a ribbon divided into three different color zones along the length thereof. Color printing is accomplished by printing a page in a first color during which the first color zone is advanced through the print station of the printer, followed by printing of the same page in a second color as the second color zone of the ribbon is advanced through the print station and then in a third color as the third color zone of the ribbon is advanced through the print station. A similar ribbon arrangement involving four different colors is shown in FIG. 3.

FIG. 3 depicts an ink ribbon 104 which may be used as the ink ribbon 72 in a printer such as the color printer 10 and which is divided into four different color zones along the length thereof between opposite first and second ends 106 and 108 respectively. The ribbon 104 includes a first color zone 110 which begins at the first end 106 and which contains yellow ink. The first color zone 110 is followed by a second color zone 112 containing red ink, then a third color zone 114 containing a blue ink and then a fourth color zone 116 which is at the second end 108 of the ribbon 104 and which contains black ink. When the ribbon 104 is advanced in a first or "forward" direction between the reels 82 and 84, the resulting forward sequence is to pass the yellow color zone 110 through the print station 24 followed by the red zone 112, the blue zone 114 and finally the black zone 116. This is a desirable sequence in that it presents the lightest color first followed by the other three colors in the order of decreasing lightness. Each time a page on the print paper 20 is printed, some of the ink previously printed on the page tends to rub off on the ribbon. Where the previously printed ink is lighter in color than the color presently being printed the rubbing off of the lighter colored ink onto the ribbon presents a relatively minor contamination problem with respect to the ribbon. However, where the ink previously deposited on the page is darker in color than the color presently being printed, even very small amounts of the darker ink have the effect of contaminating the lighter colored zone of the ribbon currently being used for printing.

For this reason the forward sequence shown in the case of the ribbon 104 of FIG. 3 is desirable. Yellow is lighter than red which in turn is lighter than blue which in turn is lighter than black. A problem arises however when the second end 108 of the ribbon 104 is reached. If the direction of ribbon drive is simply reversed, then the order of printing is reversed with black being printed first, followed by blue, then red and then yellow. If the ribbon 104 is driven in one direction only for printing so that the forward sequence is carried out, then the problem is avoided. However, this requires that printing be delayed while the ribbon 104 is driven in the reverse direction from the second end 108 back to the first end 106 so that printing can again resume. Other problems such as uneven ribbon wear also result because printing is always commenced at the same end of each of the color zones 110, 112, 114 and 116. Thus, where the driving speed of the ribbon 104 is timed so as to move each of the color zones 110, 112, 114 and 116 through the print station 24 in the time that it takes to print a full page from top to bottom in a given color, then pages containing less than a full page of print result in the repeated use of one end of each color zone to the exclusion of the opposite end of the color zone.

These problems are avoided in accordance with the invention by arranging the color zones along the length of the ribbon so that the desired printing sequence from lighter colors to darker colors is basically observed for both directions of ribbon drive. This is accomplished by repeating certain color zones in a predetermined progression or pattern along the length of the ribbon and then skipping certain zones as the ribbon is driven through the print station 24 during printing. An example of such a ribbon 118 is shown in FIG. 4. The ribbon 118 which has opposite first and second ends 120 and 122 respectively can be assumed to have essentially the same length as the ribbon 104 in FIG. 3. Instead of having just four color zones as in the case of the ribbon 104 of FIG. 3, the ribbon 118 of FIG. 4 has a considerably greater number of color zones of reduced size.

It will be seen that the ribbon 118 of FIG. 4 begins at the first end 120 with a yellow color zone (Y) 124 followed by a red color zone (R) 126, a blue color zone (BL) 128 and a black color zone (BK) 130. Such pattern is the same as that found on the ribbon 104 of FIG. 3. However, before repeating the Y-R-BL-BK sequence along the ribbon 118 an extra red color zone 132 is added. The pattern of light to dark then repeats itself with a yellow color zone 134, a red color zone 136, a blue color zone 138 and a black color zone 140. Again, an extra red color zone 142 is added following the black color zone 140. Thereafter, the light to dark pattern repeats with a yellow color zone 144, a red color zone 146, a blue color zone 148 and a black color zone 150. Again, a red color zone 152 is added following the black color zone 150. Finally, a yellow color zone 154 is added to complete the length of the ribbon 118.

The forward sequence for the ribbon 118 involves passing the yellow color zone 124 through the print station 24 followed by the red color zone 126, the blue color zone 128 and then the black color zone 130. At this point the following red color zone 132 is quickly advanced through the print station 24 without printing. Printing is then resumed using the yellow color zone 134, the red color zone 136, the blue color zone 138 and then the black color zone 140. Again, the extra red color zone 142 is quickly passed through the print station 24 without printing. Printing is then resumed using the yellow color zone 144, the red color zone 146, the blue color zone 148 and then the black color zone 150. At this point the red color zone 152 is again skipped and printing is again commenced using the yellow color zone 154.

The yellow color zone 154 which is at the second end 122 of the ribbon 118 can be advanced through the print station 24 in either the forward direction or the reverse direction as convenient. A typical example is to advance the ribbon 18 to the end 122 thereof following printing with the black color zone 150, whereupon the drive of the ribbon 118 is reversed and printing is carried out within the yellow zone 154.

Printing is then continued in the reverse direction through the red zone 152, the black zone 150 and the blue zone 148. Although the darker black zone 150 is printed before the somewhat lighter blue zone 148 is printed, the contamination effects are minimal due to the relatively small difference in lightness between the blue ink and the black ink. What is significant is that printing of the relatively dark blue ink and the even darker black ink does not preced printing of the lighter red ink which in turn does not precede printing of the still lighter yellow ink.

Following printing within the blue color zone 148, the red color zone 146 is skipped and the Y-R-BK-BL sequence is then repeated by printing through the color zones 144, 142, 140 and 138. The red color zone 136 is then skipped and printing is again carried out using the yellow color zone 134, the red color zone 132, the black color zone 130 and then the blue color zone 128. The red color zone 126 is then skipped and printing using the yellow color zone 124 is then commenced in either the reverse or the forward direction as convenient.

It will be seen that the ribbon 118 of FIG. 4 has a repeating progression or pattern which begins with the lightest color yellow which is then followed by the next darker color red and then finally one or more zones of the darkest colors which in this example comprise blue and black. The intermediate color red is then repeated before again commencing the lightest to darkest sequence Y-R-BL-BK. The lightest color yellow appears at each of the opposite ends of the ribbon 118 to insure that printing in both directions of ribbon drive will begin with the lightest color. This is also advantageous because the lightest colors tend to deplete the fastest.

The number and length of the various color zones within the ribbon 118 is determined at least in part by the printing speed of the color printer 10 and the speed of ribbon drive. In the case of one example of the printer 10 of FIG. 1 having 33 print hammers within the shuttle assembly 28, approximately 30 milliseconds are required to print each dot row across the print paper 20 with an additional 6 milliseconds being required to accomplish turnaround of the shuttle assembly 28 and advancement of the print paper 20 by one dot row position by the tractor drives 30 and 32. If printing is at a dot density of 100×100 per inch, then the time required to plot a page 11 inches long is approximately 40 seconds. At a lesser dot density of 50×50 per inch the time required to plot an 11 inch page is approximately 11.3 seconds. If the minimum acceptable ribbon speed for reasonable ribbon life is determined to be three inches per second, then $3\frac{1}{3}$ yards of ribbon are needed to print an 11 inch page in one color using 100×100 dot density, and 0.945 yards of ribbon are needed to print the same page in one color using 50×50 dot density.

In a further example of the color printer 10, the shuttle assembly 28 contains 17 print hammers instead of 33 print hammers. In that instance the total time required to print a dot row and accomplish turnaround becomes 66 milliseconds. This translates into 73 seconds being required to plot an 11 inch page at 100×100 per inch dot density and 25 seconds being required to plot the page at 50×50 per inch dot density. At a nominal ribbon speed of three inches per second, 6 yards of ribbon are required to print the page in one color at 100×100 per inch dot density, and 2.1 yards are required at 50×50 per inch dot density.

When a ribbon containing a plurality of different color zones such as the ribbon 118 is wound on the spools 82 and 84 there is a tendency for the overlapping portions of the ribbon at the interface between two adjacent color zones to bleed ink into each other, thereby creating a contamination problem. To prevent this problem the interface between each adjacent pair of color zones in the ribbon 118 is provided with at least one barrier zone. One preferred arrangement which is shown in FIG. 5 places a pair of barrier zones 156 and 158 between each adjacent pair of color zones 160 and 162. The color zones 160 and 162 could comprise any adjacent pair of color zones within the ribbon 118 such as the two color zones 124 and 126 at the first end 120 of the ribbon 118 or the color zones 138 and 140 at an intermediate portion of the ribbon 118. The barrier zone 156 interfaces with the color zone 160, while the barrier zone 158 interfaces with the color zone 162. A single cleaning zone 164 consisting of a length of blank or raw ribbon is disposed between the two barrier zones 156 and 158.

During operation of the ribbon deck 80 shown in FIGS. 1 and 2, ink from the various different color zones tends to rub off to some extent onto the guides 86, 88, 90 and 92. Such ink can rub onto a color zone of different color so as to create a contamination problem. The cleaning zone 164 minimizes or eliminates this problem by rubbing off or absorbing most of the ink from the guides 86, 88, 90 and 92. Thus, if the color zone 160 is passing over the guides 86, 88, 90 and 92 such that some of the ink from the color zone 160 rubs onto such elements, the subsequent passage of the section of raw ribbon comprising the cleaning zone 164 wipes off or otherwise absorbs most or all of such ink from the guides 86, 88, 90 and 92 prior to passage of the following color zones 162 through the print station 24 and over the guides 86, 88, 90 and 92. This prevents contamination of the color zone 162 by ink from the preceding color zone 160.

Each of the barrier zones 156 and 158 preferably has a length at least equal to the outer circumference of the reels 82 and 84. This compensates for the worst case in which the section of ribbon shown in FIG. 5 is at the outer portion of a ribbon pack wound on one of the reels 82 and 84 with the ribbon pack filling up substantially the entire reel. By making the barrier zones 156 and 158 of such minimum length, the barrier zone 156 prevents any overlap of the color zone 160 with the cleaning zone 164, and the barrier zone 158 prevents any overlap of the color zone 162 with the cleaning zone 164. The barrier zones 156 and 158 and the cleaning zone 164 together prevent any overlapping of the color zones 160 and 162. The barrier zones 156 and 158 are preferably coated with a non-wetting agent such as by spraying with a fluorochemical polymer. This prevents seepage of ink through the barrier zones 156 and 158 between adjacent segments of the ribbon.

Unlike certain multi-color ribbons of the prior art which are comprised of different segments of fabric welded together at the boundaries thereof, the ribbon 118 consists of a continuous length of fabric having no welds, seams or other joints. This makes the ribbon much less prone to breaking, pulling apart or otherwise failing.

As seen in FIG. 5 each of the barrier zones 156 and 158 has a different set of indicia 166 and 168 thereon. The set of indicia 166 serves to identify the color within the color zone 160 while the set of indicia 168 serves to identify the color within the color zone 162. Each of the sets of indicia 166 and 168 comprises one or more strips extending across the width of the ribbon between the opposite edges of the ribbon. The strips which are reflective in nature so as to be detachable by the optical sensors 94 and 96 and which are preferably applied by foil hot stamping vary in number and can also vary in width as well so as to identify the colors of the various zones in conventional bar code fashion. The use of foil hot stamping provides very thin opaque films on the ribbon with no significant buildup of ribbon thickness so as to not obstruct the paper path when passing through the print station. Sets of indicia like the sets 166 and 168 can also be used to identify the opposite ends of the ribbon as previously noted, thereby eliminating the need for conductive segments at the opposite ends of the ribbon in conjunction with electrical sensors within the guides 86 and 88 as previously described.

One example of a bar code scheme for identifying the four different ribbon colors of the present examples as well as the opposite ends of the ribbon uses five strips to identify yellow, four strips to identify red, three strips to identify blue, two strips to identify black and a single strip to identify the end of the ribbon.

The ribbons in the present examples are described in terms of the colors yellow, red, blue and black for convenience of illustration only. As previously noted different numbers of colors and different combinations of colors can be used to effect color printing in accordance with the invention. Also, in the present four color example, the red color is more technically magenta in shade, and the blue color is more technically cyan in shade.

The operation of the color printer 10 has thus far been described in terms of a single pass of each color zone of the ribbon through the print station 24 as the ribbon is driven in a given direction. As a result the printing of a given page is begun at the same edge of each color zone used in printing that page for a given direction of ribbon drive. If all or substantially all of the page contains printed matter, then virtually all of each color zone is used during the printing. If on the other hand the page contains considerably less than a full page of printed matter, then only the first portion of each color zone is used. Because many of the pages being printed by a printer such as the color printer 10 involves less than a full page of printed matter, the ribbon tends to wear unevenly. Accordingly, more even utilization of the ribbon color zones would have the effect or prolonging the useful life of the ribbon.

A further problem can occur in terms of the speed or efficiency of printing when a single pass of each color zone through the print station is utilized. Again, where a given page being printed has less than a full page of printed matter thereon, then only the first portion of the pass through each color zone is accompanied by printing. The printer must sit idly through the latter portion of each such pass awaiting arrival of the next color zone at the print station before printing in the next color can begin.

A printing technique in accordance with the invention which tends to distribute ribbon wear more uniformly and which at the same time tends to make the printing process faster and more efficient utilizes multiple passes of each color zone of the ribbon through the print station 24 of the color printer 10. Such technique is illustrated in FIGS. 6 and 7. The example of FIG. 6 involves three different passes of each color zone through the print station 24. Thus, a yellow color zone 170 makes a first pass 172 through the print station 24 in one direction, followed by a second pass 174 through the print station 24 in the opposite direction. The second pass 174 is followed by a third pass 176 which again is in the first direction. A similar sequence of three different passes is utilized within each of the following red, blue and black color zones 178, 180 and 182 during the continuation of the sequence.

The three different passes within each color zone such as the passes 172, 174 and 176 within the yellow color zone 170 are accomplished by the servo system 102 which responds to the bar coded signals from the optical sensors 94 and 96 indicating when the opposite ends of the various color zones are reached. Thus, in the case of the yellow color zone 170, the servo system 102 causes the zone 170 to pass through the print station 24 to complete the first pass 172. When an end 184 of the yellow color zone 170 reaches the print station 24, this condition is sensed by one of the sensors 94 and 96, and the servo system 102 responds by reversing the direction of ribbon drive to commence the second pass 174. The second pass 174 continues until an opposite end 180 of the yellow color zone 170 is reached. When the end 186 is reached, the associated bar code indicia is sensed by one of the sensors 94 and 96, and the servo system 102 responds by again reversing the direction of ribbon drive to commence the third pass 176 of the yellow color zone 170 through the print station 24. At the end of the third pass 176, the servo system 102 ignores the occurrence of the end 184 because of the presence of counting circuitry therein which determines that the three passes of the yellow color zone 170 have been made. The servo system 102 simply continues into the red color zone 78 where the three pass process is repeated.

It will be seen that the three pass technique shown in FIG. 6 tends to utilize both ends of each color zone as well as the intermediate portions of the zone. Such technique also lends itself to a faster and more efficient printing technique as well, as illustrated in FIG. 7 which again shows the four color zones 170, 178, 180 and 182 of the example of FIG. 6. In the technique illustrated in FIG. 7 a determination is made with respect to the amount of information to be printed on a given page. This is easily accomplished because the information to be printed is typically inputted into and stored within the printer 10 prior to printing as described in connection with the previously referred to U.S. Pat. No. 3,941,051 of Barrus et al. Consequently it can be determined prior to or at least at the end of the first sweep through the first color one during printing of a given page whether printing of the page has been completed or whether additional passes are necessary. The example shown in the lower portion of FIG. 7 assumes a case in which only the very top portion of the given page to be printed involves printed matter. Because the length of the printed matter is less than $\frac{1}{3}$ page, only a single pass is required through each of the four color zones 170, 178, 180 and 182 to accomplished printing of the page. This condition is illustrated by the line 187 in the bottom postion of FIG. 7. Prior determination of the length of the page to be printed enables the servo system 102 to proceed with a single pass through each of the color zones. Moreover, a high speed search mode of operation can be used to advance the ribbon to the next color zone at higher speed following termination of printing.

Because multiple passes through each color zone are contemplated in the examples of FIG. 7, the various color zones of the ribbon can be shortened or the nominal ribbon speed can be increased compared to the single pass approach previously described. Accordingly, even when printing is completed part way through each of the color zones 170, 178, 180 and 182, the time required to proceed to the next color zone is considerably less than in the case of the single pass approach.

FIG. 7 illustrates a further example at the top portion thereof which involves a determination that the information to be printed on a given page occupies only approximately $\frac{1}{2}$ the page. In such example a first pass 188 is made through the yellow color zone 170 followed by a reversal in the direction of ribbon drive and the commencement of a second pass 190. Approximately half the way through the second pass 190, it is determined that printing of the page in yellow has been completed. At that point the direction of the ribbon drive is again reversed and the system proceeds directly to the red color zone 178 by making a shortened third pass 192 through the second half of the yellow color zone 170. The high speed search mode is preferably entered so as to accomplish the third pass 192 at high speed. A similar three pass procedure is followed through each of the remaining color zones 178, 180 and 182 to complete the printing of the given page.

It will be seen that where a multiple pass printing technique is used, an odd number of passes is made through each group of four color zones in the present example. It is possible for a single pass to be made through each of the four color zones as shown by the line 187 of the example in the lower portion of FIG. 7. Also, as shown in FIG. 6 and in the top portion of FIG. 7 three different passes through each color zone are also possible, in which event the passes may be complete passes in the sense of covering the entire length of each color zone as in the case of FIG. 6 or they may involve several shortened passes as in the example at the top portion of FIG. 7. In any case two direction reversals of the ribbon drive are involved within each color zone except in those instances where only a single pass is required by a page of relatively short length.

Figure 9:
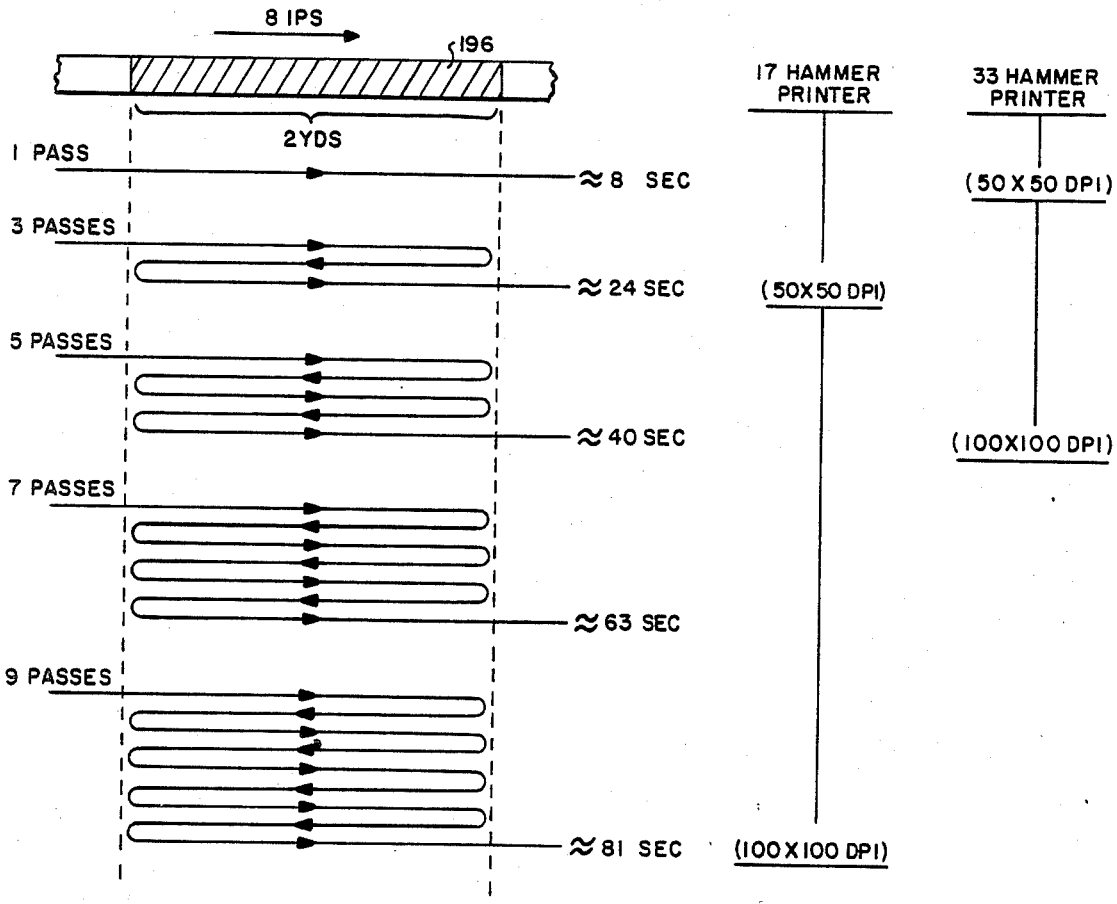
FIG. 9 is a representation of a portion of the ribbon of FIG. 4 illustrating the manner in which different numbers of passes of a color zone are selected for different dot densities and numbers of hammers within the shuttle mechanism of the printer of FIG. 1 for a given nominal ribbon speed and a given length of the color zone.

As discussed hereafter in connection with FIG. 9 a multiple pass technique of operation need not be limited to three passes but can involve other odd numbers of passes such as five, seven or nine.

Figure 8:
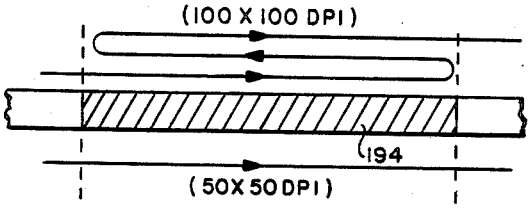
FIG. 8 is a representation of a portion of the ribbon of FIG. 4 illustrating the manner in which different numbers of passes of each color zone can be employed to effect printing at different dot densities for a given nominal ribbon speed and color zone size.

FIG. 8 is useful in explaining the manner in which the lengths of the various color zones of a ribbon can be chosen so as to provide for a ribbon of desired overall length in the face of different usable dot densities. In the example of a shuttle assembly 28 having 17 print hammers, a single pass of the color zone requires approximately 25 seconds to accomplish at a ribbon speed of 2.9 inches per second if the color zone is approximately two yards in length and the printing density is 50×50 dots per inch. When the print density is increased to 100×100 dots per inch, then it can be determined that 73 seconds within the color zone are required if the color zone is approximately two yards long and the ribbon speed is 3 inches per second. This can be accomplished without lengthening the two yard long color zone by making three passes through the color zone.

Thus, as illustrated in FIG. 8 a color zone 194 which has a length of two yards and is moving at a nominal speed of 3 inches per second requires a single pass thereof in the case of 50×50 dots per inch print density and three passes thereof in the case of 100×100 dots per inch print density. Again, this assumes a 17 print hammer shuttle assembly 28.

In the example of 33 print hammer shuttle assembly 28, the printing speed is virtually doubled. However each of the color zones such as the zone 194 shown in FIG. 8 can be maintained at the two yard length simply by doubling the nominal ribbon speed to 6 inches per second. Accordingly, the techniques illustrated in FIG. 8 apply to a 33 hammer system as well as a 17 hammer system if the nominal ribbon speed is doubled to 6 inches per second.

The two yard nominal length of a color zone can be used to make a ribbon similar to the ribbon 118 shown in FIG. 4 but having a total of 26 color zones. The 26 color zones require a total of 52 yards of ribbon length, and the intervening barrier and cleaning zones such as shown in FIG. 5 require approximately 8 additional yards of ribbon length. This provides for a total ribbon length of 60 yards which is a standard ribbon length used in dot matrix printers of this type.

FIG. 9 provides a further illustration of the manner in which multiple pass operation can be utilized in conjunction with a nominal ribbon speed and color zone length to make the same ribbon usable at different dot densities and within printers having different numbers of print hammers. In the example of FIG. 9 the ribbon is driven at a nominal speed of 8 inches per second, and a color zone 196 shown therein has a length of two yards. The approximate times required to make one, three, five, seven and nine passes through such color zone are illustrated. Based on this it can be determined that a 17 hammer printer requires three passes through each color zone for a dot density of 50×50 dots per inch and nine passes through each color zone for a dot density of 100×100 dots per inch. A 33 hammer printer requires a single pass through each color zone for a dot density of 50×50 dots per inch, and five passes each color zone for a dot density of 100×100 dots per inch.

Figure 10:
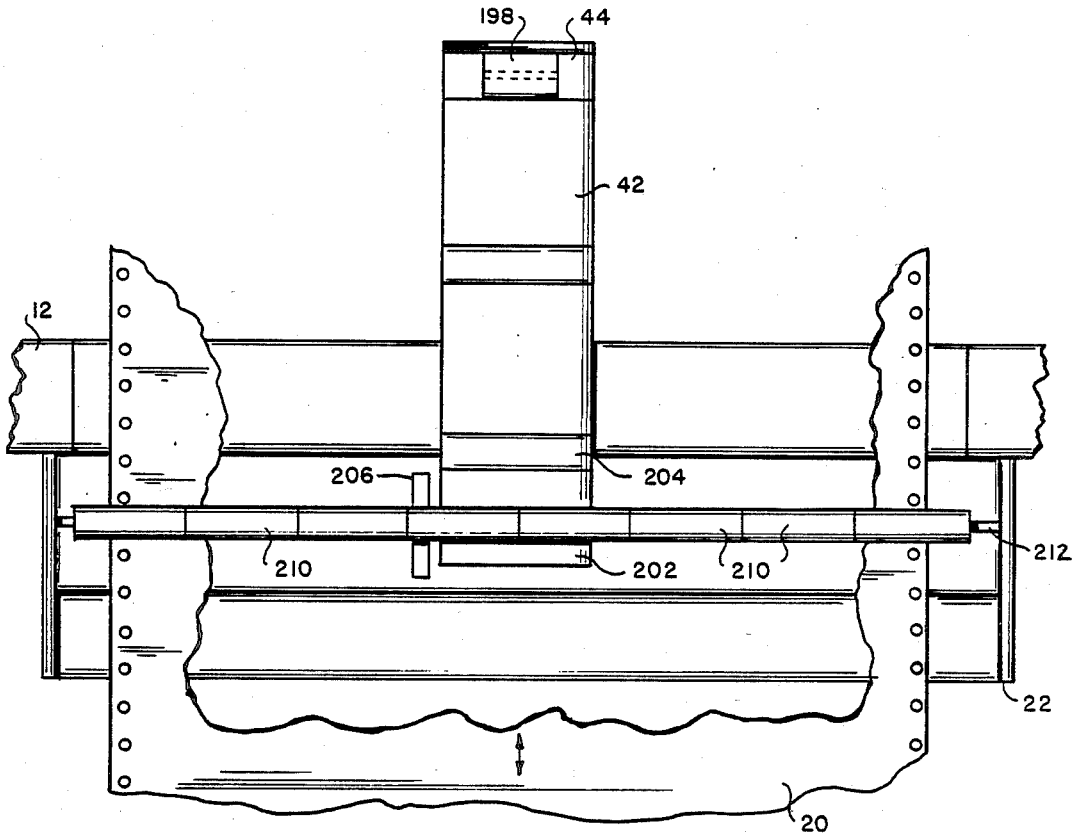
FIG. 10 is a front view of a portion of the printer of FIG. 1 illustrating an arrangement for maintaining the print paper under desired tension during bidirectional advancement thereof.

As previously noted the tractor drives 30 and 32 increment the print paper 20 in an upward direction through each of the successive dot row positions of a page during printing thereof in a given color, following which the paper is driven in the reverse direction to return to the beginning of the page in preparation for printing of the next color. It is desirable to be able to hold the print paper 20 in tension as it moves through the print station 24 in either direction. This is accomplished by the arrangement shown in FIGS. 10–12 which includes the elongated bracket 42 and the rectangular housing 22 previously noted in connection with FIG. 1. As noted in connection with FIG. 1 the elongated bracket 42 is pivotally coupled to the shaft 36 of the tractor drives 30 and 32 at the upper end 44 thereof. The pivotal mounting is accomplished by a hinge member 198 coupled to the upper end 44 of the bracket 42 and having an aperture 200 therein for receiving the shaft 36.

A torque motor 202 is mounted on the bracket 42 at a lower end 204 thereof opposite the upper end 44. The torque motor 202 has a drive wheel 206 coupled to be rotatably driven thereby. The drive wheel 206 has an elastomeric outer surface such as of rubber to provide traction between the wheel 206 and the print paper 20. A rectangular-shaped permanent magnet 208 is mounted on the bracket 42 at an intermediate portion thereof between the upper end 44 and the lower end 204. The permanent magnet 208 normally attaches to the back of the platen 26 by magnetic attraction to hold the pivotal bracket 42 in an operative position in which the drive wheel 206 of the torque motor 202 engages the back side of the print paper 20.

With the bracket 42 in the operative position, the drive wheel 206 presses the print paper 20 against an arrangement of rollers 210. The rollers 210 are rotatably mounted in side-by-side fashion along the length of a shaft 212 extending between and mounted on the opposite ends of the rectangular housing 22. Consequently, the various rollers 210 extend across the width of the print paper 20. The various rollers 210 are made of a non-wetting material such as Delrin so as to have an outer surface which does not absorb ink. This is important because the rollers 210 come in contact with portions of the print paper 20 which have already been printed in one or more colors when the paper 20 is reversed and moved downwardly to return to the top of a given page being printed in preparation for printing in the next color. The drive wheel 206 which pushes the back of the print paper 20 against the rollers 210 need not have a non-wetting outer surface as it contacts a side of the paper which does not contain ink.

In operation of the torque motor 202 is driven in the same direction as the tractor drives 30 and 32, but at a different rate. When the print paper 20 is driven in an upward direction by the tractor drives 30 and 32, the torque motor 202 causes the drive wheel 206 to rotate in the direction of upward paper movement at a slower rate. This creates a desired amount of tension in the print paper 20 within the print station 24. When the print paper 20 is driven in a downward direction by the tractor drives 30 and 32, the torque motor 202 is driven so as to rotate the drive wheel 206 in a direction of downward paper movement at a slightly faster rate than that provided by the tractor drives 30 and 32. This acts to maintain the desired tension within the paper 20 at the print station 24.

As previously noted the permanent magnet 208 clamps to the back of the platen 26 to hold the bracket 42 in the operative position in which the drive wheel 206 presses the print paper 20 against the rollers 210. The bracket 42 may be pivoted out of the operative position to move the drive wheel 206 away from the print paper 20 and thereby facilitate loading and unloading of the paper within the printer 10. This is accomplished by action of a relatively flat cam 214 which is mounted on the top of the platen 26 and which has an edge of slightly tapered thickness that engages the permanent magnet 208 so as to push the magnet 208 and the attached bracket 42 outwardly when the platen 26 is rotated. The platen 26 is made rotatable about a shaft 216 therethrough as shown by an arrow 218. Because the shaft 216 is off-center relative to the platen 26, rotation of the platen 26 pulls it away from the shuttle assembly 28 to facilitate loading and unloading of the print paper 20. Thus, at the same time that the platen 26 is rotated to open such space, the cam 214 engages the permanent magnet 208 to push the bracket 42 outwardly and thereby move the drive wheel 206 which is coupled to the torque motor 202 away from the rollers 210.

The rectangular housing 22 includes a paper guide arrangement having an opposite pair of paper guides 220 and 222. The paper guides 220 and 222 which extend along the length of the rectangular housing 22 at the inside of the housing 22 extend upwardly in a direction toward the drive wheel 206 and the rollers 210. The paper guides 220 and 222 converge toward each other as they extend upwardly until they reach an area of minimum separation therebetween immediately below the drive wheel 206 and the rollers 210 as shown in FIG. 11.

The paper guides 220 and 222 facilitate loading of the print paper into the color printer 10. As shown in FIG. 1 a paper stack 18 is normally disposed on the front portion 16 of the support pedestal 14. The stack 18 comprises a folded length of the print paper 20. The print paper 20 is loaded by pulling it upwardly and inserting it into the bottom of the rectangular housing 22. At this point the paper guides 220 and 222 serve to guide the edge of the paper as it is moved upwardly between the drive wheel 206 and the rollers 210, through an opening in the base 12, between the platen 26 and the shuttle assembly 28 and into the tractor drives 30 and 32.

FIG. 13 illustrates a roller guide which is preferably used as the guides 86, 88, 90 and 92 shown in FIG. 2. The guides used in a ribbon deck of this type normally comprise a fixed member or post around which the ribbon is drawn. The practical result is that some of the ink from the ribbon rubs onto the guide. This is not a particular problem in the case of an all black ribbon used in black and white printing. In the case of color printing however, ink from one color zone which is deposited on a guide and thereafter rubs off on a different color zone creates a contamination problem.

Such problem can be minimized by use of the roller guide 224 shown in FIG. 13. The roller guide 224 comprises a spool 226 having opposite flanges 228 and 230 of greater diameter and which is rotatably mounted on a vertical shaft 232 which in turn is mounted on the deck 80. The rotatably mounted spool 226 is free to rotate with the ribbon 72 as the ribbon 72 is bidirectionally driven. Rotation of the spool 226 with the ribbon 72 acts to greatly minimize the amount of ink from the ribbon 72 which is deposited thereon, when contrasted with the fixed ribbon guides of the prior art. Moreover, the outer surface of the spool 226 is comprised of a non-wetting material such as Teflon which does not absorb ink from the ribbon 72. This also greatly minimizes the amount of ink from the ribbon 72 which is deposited on the spool 226.

While the invention has been particularly shown and described with reference to preferred embodiments thereof, it will be understood by those skilled in the art that various changes in form and details may be made therein without departing from the spirit and scope of the invention.

What is claimed is:

1. A method of color printing with an impact printer having at least one impacting element which impacts a ribbon having a plurality of different color zones spaced along the length of the ribbon, comprising the steps of advancing the ribbon relative to the impacting element to impact each of the plurality of different color zones and thereby print in a color contained in the color zone in sequence, and within each of at least some of the color zones reversing the direction of movement of the ribbon at least twice to provide plural passes of each of the at least some of the color zones relative to the at least one impacting element, the step of reversing the direction of movement of the ribbon at least twice within each of at least some of the color zones including the further steps of determining an amount of printing to be done, advancing substantially the entire length of a color zone relative to the at least one impacting element in a first direction at a nominal speed to provide a first pass, advancing the color zone relative to the at least one impacting element in a second direction opposite the first direction at the nominal speed by an amount determined by the amount of printing to be done to provide a second pass, and thereafter advancing the color zone relative to the at least one impacting element in the first direction at a speed greater than the nominal speed to an end of the color zone to provide a third pass.

2. A ribbon for use in a color printer, the ribbon having a plurality of different color zones spaced along the length thereof between opposite first and second ends of the ribbon with each color zone occupying a different portion of the length of the ribbon, the different color zones having colors of varying degrees of lightness therein and defining a repeating pattern along the length of the ribbon between the opposite first and second ends which includes a succession of color zones of descending lightness beginning with a color of greater lightness and progressing through at least one color of lightness less than the greatest lightness to a color of least lightness followed by a succession of color zones of ascending lightness beginning with at least one color of lightness less than the greatest lightness and progressing to the color of greatest lightness, whereby repeating sequences of colors of decreasing lightness can be addressed while moving along the length of the ribbon in either direction by skipping selected color zones.

3. A color printer comprising the combination of a platen, a shuttle assembly containing a plurality of impacting elements and disposed for bidirectional, reciprocating motion adjacent the platen, a multi-color ribbon having a portion of the length thereof disposed between the platen and the shuttle assembly, means for driving the multi-color ribbon in first one direction and then in an opposite direction between the platen and the shuttle assembly, and means for advancing a length of paper between the platen and the shuttle assembly and adjacent the portion of the length of the ribbon disposed therebetween in bidirectional fashion, the multi-color ribbon having a plurality of different color zones spaced along the length thereof between opposite first and second ends of the ribbon with each color zone occupying a different portion of the length of the ribbon, the different color zones having colors of varying degrees of lightness therein and defining a repeating pattern along the length of the ribbon between the opposite first and second ends which includes a succession of color zones of descending lightness beginning with a color of greatest lightness and progressing through at least one color of lightness less than the greatest lightness to a color of least lightness followed by a succession of color zones of ascending lightness beginning with at least one color of lightness less than the greatest lightness and progressing to the color of greatest lightness, whereby repeating sequences of colors of decreasing lightness can be disposed between the platen and the shuttle assembly when the means for driving drives the ribbon in either the one direction or the opposite direction by skipping selected color zones.

4. The invention set forth in claim 3, wherein the ribbon has a plurality of barrier zones with each barrier zone occupying a different portion of the length of the ribbon and a plurality of blank ribbon zones with each blank ribbon zone occupying a different portion of the length of the ribbon, each adjacent pair of color zones being separated by a pair of the plurality of barrier zones and one of the blank ribbon zones, each of the pair of barrier zones being disposed adjacent a different one of the adjacent pair of color zones and the blank ribbon zone being disposed between the pair of barrier zones.

* * * * *